US006173707B1

(12) United States Patent
Howell et al.

(10) Patent No.: US 6,173,707 B1
(45) Date of Patent: Jan. 16, 2001

(54) ARCHERY BOW FIREARM BRACE AND GUARD

(76) Inventors: Dewight A. Howell; Cinda Howell, both of HC 67 Box 2030, Lovely, KY (US) 41231

( * ) Notice: Under 35 U.S.C. 154(b), the term of this patent shall be extended for 0 days.

(21) Appl. No.: 09/514,299

(22) Filed: Feb. 28, 2000

(51) Int. Cl.[7] ..... F41B 5/14
(52) U.S. Cl. ..... 124/88
(58) Field of Search ..... 124/23.1, 24.1, 124/25.6, 86, 88

(56) References Cited

U.S. PATENT DOCUMENTS

| | | | | |
|---|---|---|---|---|
| 3,167,062 | * | 1/1965 | Zwickey | 124/23.1 |
| 4,048,674 | | 9/1977 | Chesnick . | |
| 4,343,286 | * | 8/1982 | Thacker | 124/88 X |
| 4,714,071 | * | 12/1987 | Saunders | 124/88 |
| 4,787,361 | * | 11/1988 | Vyprachticky | 124/88 |
| 4,836,177 | | 6/1989 | Williams | 124/89 |
| 5,103,798 | | 4/1992 | McGraw et al. | 124/88 |
| 5,137,008 | | 8/1992 | Taylor | 124/88 |
| 5,320,085 | | 6/1994 | Hanneman | 124/89 |
| 5,351,867 | | 10/1994 | Vest . | |
| 5,464,002 | | 11/1995 | Lavoie et al. | 124/86 |
| 5,531,211 | | 7/1996 | Wilfong, Jr. | 124/86 |
| 5,535,731 | | 7/1996 | Webster | 124/89 |
| 5,944,004 | | 8/1999 | Goff et al. | 124/35.2 |

FOREIGN PATENT DOCUMENTS 2614981 11/1988 (FR) .

* cited by examiner

*Primary Examiner*—John A. Ricci
(74) *Attorney, Agent, or Firm*—Richard C. Litman

(57) ABSTRACT

An archery bow forearm brace and guard comprises a pair of spaced apart elongate arms which secure respectively to the conventional overdraw arrow rest and stabilizer attachment points of a conventional compound or long bow, and extend rearwardly therefrom. One or more interconnecting cross members extends between the two longitudinal arms and serve as a guard to hold the bow holding forearm of the archer clear of the bowstring path when it is released. The crossmembers may be permanently affixed, or adjustably secured to the longitudinal arms to provide adjustment for the length of the archer's forearm and other variables. The crossmembers include a forearm attachment assembly which secures about the archer's forearm, to secure the apparatus and bow to which it is attached, positively to the archer's forearm. The forearm attachment and bowstring guard are easily and quickly attachable to and detachable from the remainder of the device, by quick release attachments. The straps which secure about the archer's forearm are also preferably quickly fastenable and releasable. The present device not only serves as a forearm guard and steadying brace for the archer, but also serves the function of a stabilizer device, due to the rearwardly disposed mass of the device and the mass of the archer's forearm to which it is secured for shooting. The present invention provides increased accuracy for archery shots, due to the positive bracing and attachment of the bow to the archer's forearm and the stabilizing influence of the bow, stabilizer, and forearm interconnection.

20 Claims, 5 Drawing Sheets

ARCHERY BOW FIREARM BRACE AND GUARD

BACKGROUND OF THE INVENTION

1. Field of the Invention

The present invention relates generally to the field of archery equipment, and more specifically to a device which secures both to an archery bow and to the forearm of the archer using the bow. The present invention thus serves to lock the bow and the archer's forearm immovably together to provide stability for the bow as the arrow is being released, and also maintains clearance between the archer's forearm and the bowstring as it is released.

2. Description of the Related Art

Archery, and particularly archery hunting, has become an ever more popular sport, particularly as hunting laws have evolved to provide a longer season and/or other advantages for archery hunters as opposed to those who hunt with firearms. Accordingly, archers have developed ever more powerful bows and continue to seek ever more sophisticated equipment and accessories in order to maximize the accuracy and power of each shot. For example, it has long been known that the bow will tend to vibrate and twist upon release of the bowstring, and accordingly, various bow stabilizing devices have been developed. Another problem is the contact of the bowstring along the archer's forearm when the string is released, which has resulted in the development of various forearm guards.

Each of these various devices must either be attached to the bow or to the archer's arm in some way, with even more devices (bow sights, overdraw attachments for shorter arrows, etc.) having been developed for attachment to an archery bow. While each of the above noted accessories assists the archer in the accuracy and/or power of a shot, it will be noted that none provide a solid, secure attachment of the bow to the archer's arm, in order to minimize movement and play therebetween. Also, the relatively large number of various accessories available can easily outnumber the available locations on a bow for the attachment of such accessories to the bow.

Accordingly, a need will be seen for a rigid device which secures immovably to an archery bow, and which also attaches securely to the forearm of the archer, to provide a solid and essentially fixed link between the archer and the bow. The present invention must also provide other functions as well, serving as an arm guard to preclude contact of the bowstring against the forearm of the archer upon release of the string. The mass of the device (along with the forearm of the archer) also serves as a stabilizer for the bow assembly, with all of the above functions being accomplished by means of only two attach points to the bow.

A discussion of the related art of which the present inventor is aware, and its differences and distinctions from the present invention, is provided below.

U. S. Pat. No. 4,048,674 issued on Sep. 20, 1977 to John C. Chesnick, titled "Arm Guard For Archers," describes a flexible forearm guard formed of leather or equivalent material with a layer of padding thereunder. The device straps only about the forearm of the archer, and does not connect in any way to the bow, as does the present forearm brace and guard. Moreover, the lack of attachment to the bow results in the Chesnick guard being unable to maintain clearance between the bowstring and the guard when the string is released, which clearance is provided by the present brace and guard. As the Chesnick guard does not attach to the bow in any way, it cannot act as a stabilizer for the bow, as does the present invention.

U. S. Pat. No. 4,836,177 issued on Jun. 6, 1989 to Bill R. Williams, titled "Archery Bow Wrist Brace Apparatus," describes a brace which bolts to the forward stabilizer attach point of the bow. The device comprises a rearwardly extending, padded rigid loop for passing over the archer's forearm. A transverse secondary strap passes beneath the forearm, forwardly of the overlying loop portion of the brace. The archer need only pass his hand upwardly between the transverse loop and strap portions of the device, to apply the device; it does not positively strap about the forearm, as does the present brace and guard. While the Williams device may limit upward movement of the bow during a shot, it does not limit movement in other directions, as does the present invention. Moreover, the Williams device does not prevent contact of the bowstring with the device or forearm, as does the present invention.

U. S. Pat. No. 5,103,798 issued on Apr. 14, 1992 to Michael F. McGraw et al., titled "Archery Arm Guard," describes a guard comprising an elongate, rigid rod which extends rearwardly from an attach point at the general center of the bow. The McGraw et al. guard extends along the forearm of the archer, between the archer's forearm and the bowstring when the bow is held for a shot. The bowstring will slide along the guard, rather than contacting the archer's forearm, if the string is aligned too closely to the forearm when released. The device does not positively attach to the archer's forearm and thus does nothing to positively brace the bow and forearm together, as does the present brace and guard. Moreover, the relatively light mass of the McGraw et al. guard does not provide significant stabilizing influence, as does the present brace and guard.

U. S. Pat. No. 5,137,008 issued on Aug. 11, 1992 to Anthony Taylor, titled "Arm Guard," describes various embodiments essentially comprising an arm or plate attached to the accessory attachment area of the center of the bow, with another plate extending rearwardly from the first plate or arm. The Taylor device does not secure to the archer's arm, and thus cannot serve to stabilize the bow relative to the forearm of the archer, as does the present invention. Moreover, as the present invention comprises an attachment between the bow and the forearm of the archer, it also serves to preclude contact with any part of the guard itself. This is not accomplished with the Taylor device, which merely serves to absorb any impact of the bowstring.

U. S. Pat. No. 5,320,085 issued on Jun. 14, 1994 to Richard Hanneman, titled "Bow Stabilizing Arm," describes an arcuately and telescopically adjustable arm which attaches to the conventional stabilizer attachment point of a compound or other bow. The Hanneman device includes a concave brace portion at the distal end of the arm, for bracing against a part of the archer's body or other object, depending upon adjustment. However, Hanneman does not provide any means for positively securing the stabilizer arm to any part of the archer's body, particularly the forearm, as is done with the present stabilizer and arm guard. Moreover, the Hanneman device cannot serve as an arm guard, and does nothing to prevent the bow string from contacting the archer's forearm, whereas the present invention serves as a forearm guard, brace, and stabilizer all in a single device.

U. S. Pat. No. 5,351,867 issued on Oct. 4, 1994 to Clyde L. Vest, titled "Arm Steady Brace," describes a brace arm which may be placed between the waist and bow holding forearm of an archer or firearm shooter. The device attaches to the belt of the archer, but has only a concave brace at its distal end, in the manner of the Hanneman brace and stabilizer discussed above. Thus, the Vest brace cannot be positively attached to the archer's forearm, as can the present invention. Moreover, the Vest brace does not attach to the bow in any way, and thus cannot be used to stabilize the holding of the bow by the archer, as provided by the present invention. Also, the Vest device cannot act as a forearm guard, due to its lack of attachment to the bow.

U. S. Pat. No. 5,464,002 issued on Nov. 7, 1995 to Camilien Lavoie et al., titled "Archery Armguard Device," describes a device which clamps to a conventional rearwardly projecting stabilizer rod. The device comprises a wire frame or solid sheet of material which is offset toward the forearm of the archer, and prevents the forearm from moving too closely to the path of the bowstring when it is released. However, the Lavoie et al. device does not attach or secure positively to the forearm of the archer, as does the present invention, and thus cannot provide the same benefits of stabilizing of the bow and forearm together, as are achieved by the present invention. Moreover, the Lavoie et al. device requires an existing stabilizer rod, whereas the present stabilizer and arm guard secures to the existing attachment points for such accessories on the bow.

U. S. Pat. No. 5,531,211 issued on Jul. 2, 1996 to Gary R. Wilfong, Jr., titled "Archery Arm Guard," describes an assembly which secures to the back of a compound bow and includes a pair of adjustably spaced, rearwardly extending bars. One bar serves as a cable guard, precluding contact of the intermediate cables which run between the tips of the bow and opposite pulleys. The other bar serves as a forearm guard, and is laterally spaced from the first bar by an adjustable linkage. While the Wilfong, Jr. guard does prevent the bowstring from contacting the forearm of the archer, the assembly does not positively secure to the archer's forearm to provide a rigid brace between the archer and the bow, as provided by the present invention.

U. S. Pat. No. 5,535,731 issued on Jul. 16, 1996 to Mark A. Webster, titled "Archery Bow Stabilizer," describes a device which attaches to the front side of the bow at the standard stabilizer arm attachment point thereof. The Webster device comprises a block with four arms extending therefrom, with one arm extending into each of the quadrants defined by the horizontal longitudinal and lateral axes of the bow. The arms are downwardly disposed, for clearance from the archer's arm and the bowstring and arrow. Thus, Webster teaches away from the present invention, where a stabilizer brace secures positively to the bow and also to the forearm of the archer to tie the two together for greater stability. The Webster device also does nothing to preclude contact of the bowstring with the archer's forearm, as it extends forwardly of the bow, rather than rearwardly as in the present invention.

U. S. Pat. No. 5,944,004 issued on Aug. 31, 1999 to Jerry A. Goff et al., titled "Archery Stabilizer And Drawlock," describes a device which attaches to the attachment point for an overdraw arrow rest at the central area of the bow, and extends rearwardly therefrom. The Goff et al. device is adjustable in length and provides for holding the bowstring when drawn, as in a crossbow. While the rearwardly extending mass of the Goff et al. device may serve to stabilize the bow to some extent, the Goff et al. device does not contact or secure in any way to the bow holding forearm of the archer, as provided by the present stabilizer and bowstring guard. Moreover, no protection for the forearm from the bowstring is provided by the Goff et al. device.

Finally, French Pat. Publication No. 2,614,981 published on Nov. 10, 1988 to Societe Nouvelle Regnier describes (according to the English abstract) an elbow brace including a bowstring release extending forwardly therefrom. No means of attaching or bracing the device to the bow is apparent from the French Patent Publication, nor is any protection from the bowstring apparent, as provided by the present forearm brace and guard.

None of the above inventions and patents, either singly or in combination, is seen to describe the instant invention as claimed.

SUMMARY OF THE INVENTION

The present invention comprises various embodiments of an archery bow forearm brace and guard, with the device serving both of the above purposes as well as providing a stabilizing function. The present brace and guard comprises a frame having upper and lower longitudinal members which attach respectively to the conventional overdraw arrow rest and stabilizer attach points of a conventional compound bow (the device may also be used with a conventional long bow, as well). The longitudinal arms may secure to the front of the bow and extend rearwardly around the bow, or may secure to rearwardly disposed attach points, depending upon the specific configuration of the bow. A bracket is removably and adjustably secured to the two longitudinal arms, and includes a forward and a rearward strap for positively securing about the bow holding forearm of the archer, thus securing the remainder of the device (and attached bow) positively to the archer's forearm.

Accordingly, it is a principal object of the invention to provide an improved archery bow forearm brace and guard, for positively securing the archer's bow holding forearm to the bow.

It is another object of the invention to provide an improved bow forearm brace and guard which holds the archer's forearm clear of the path of the bowstring when it is released, thereby preventing contact of the bowstring with the archer's forearm.

It is a further object of the invention to provide an improved forearm brace and guard which provides a bow stabilizing function, due to its rearwardly disposed mass and the mass of the archer's forearm to which the device and its attached bow are secured.

An additional object of the invention is to provide an improved forearm brace and guard which attaches to two separate existing accessory attachment points of a conventional long bow or compound bow.

Still another object of the invention is to provide an improved forearm brace and guard which forearm attachment is quickly and easily attachable to and removable from the longitudinally disposed bow attachment arms or members.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of an archery bow forearm brace and guard which serves to secure the bow holding forearm of the archer immovably to the bow and to preclude contact of the bowstring with the archer's bow holding forearm when the string is released. The present invention provides other advantages as well, such as providing additional stabilizing mass extending from the bow.

Figure 1:
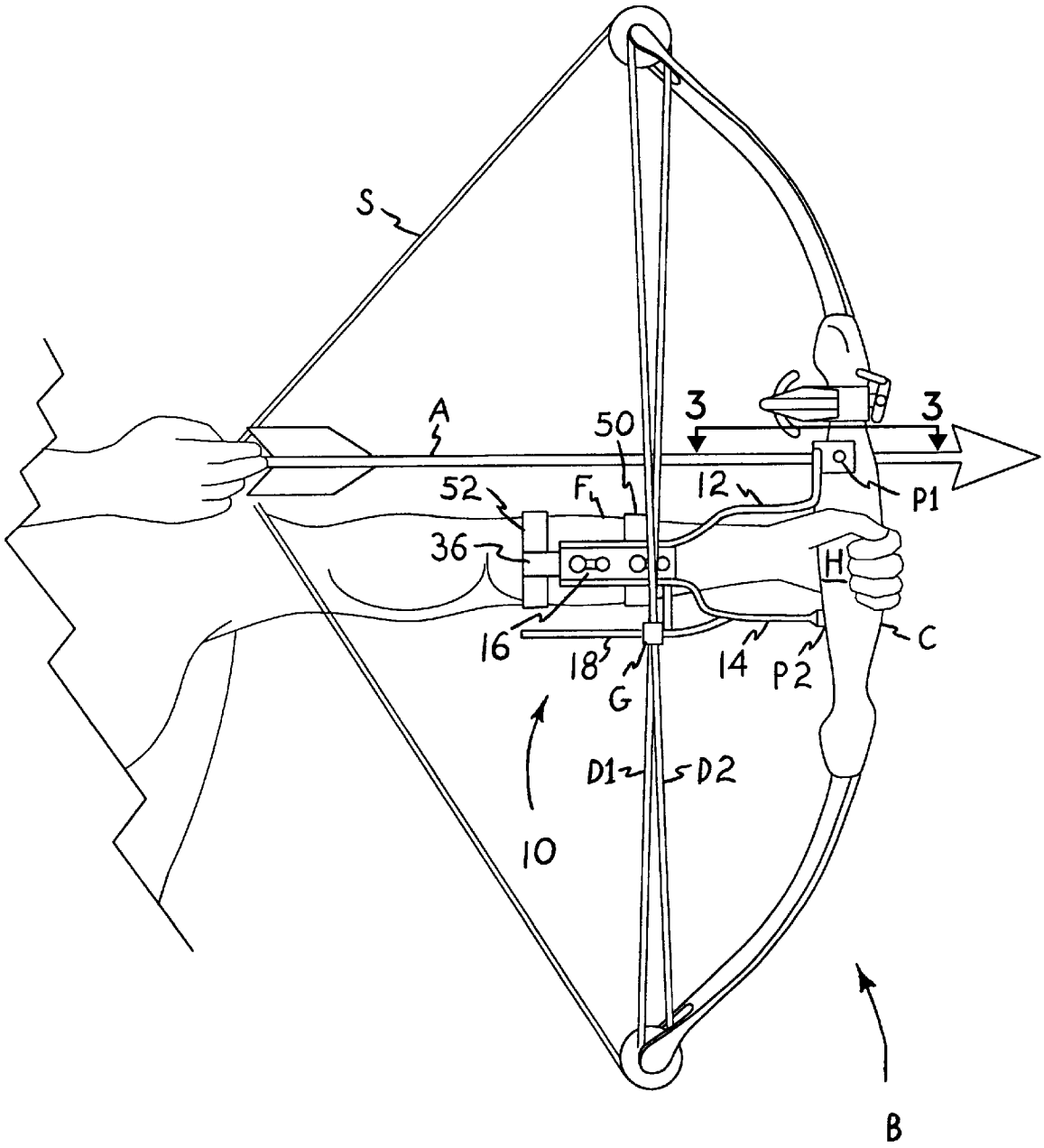
FIG. 1 is an environmental right side elevation view of a first embodiment of the present forearm brace and guard installed on a compound bow and secured to the bow holding forearm of an archer, showing the use of the device.
Figure 2:
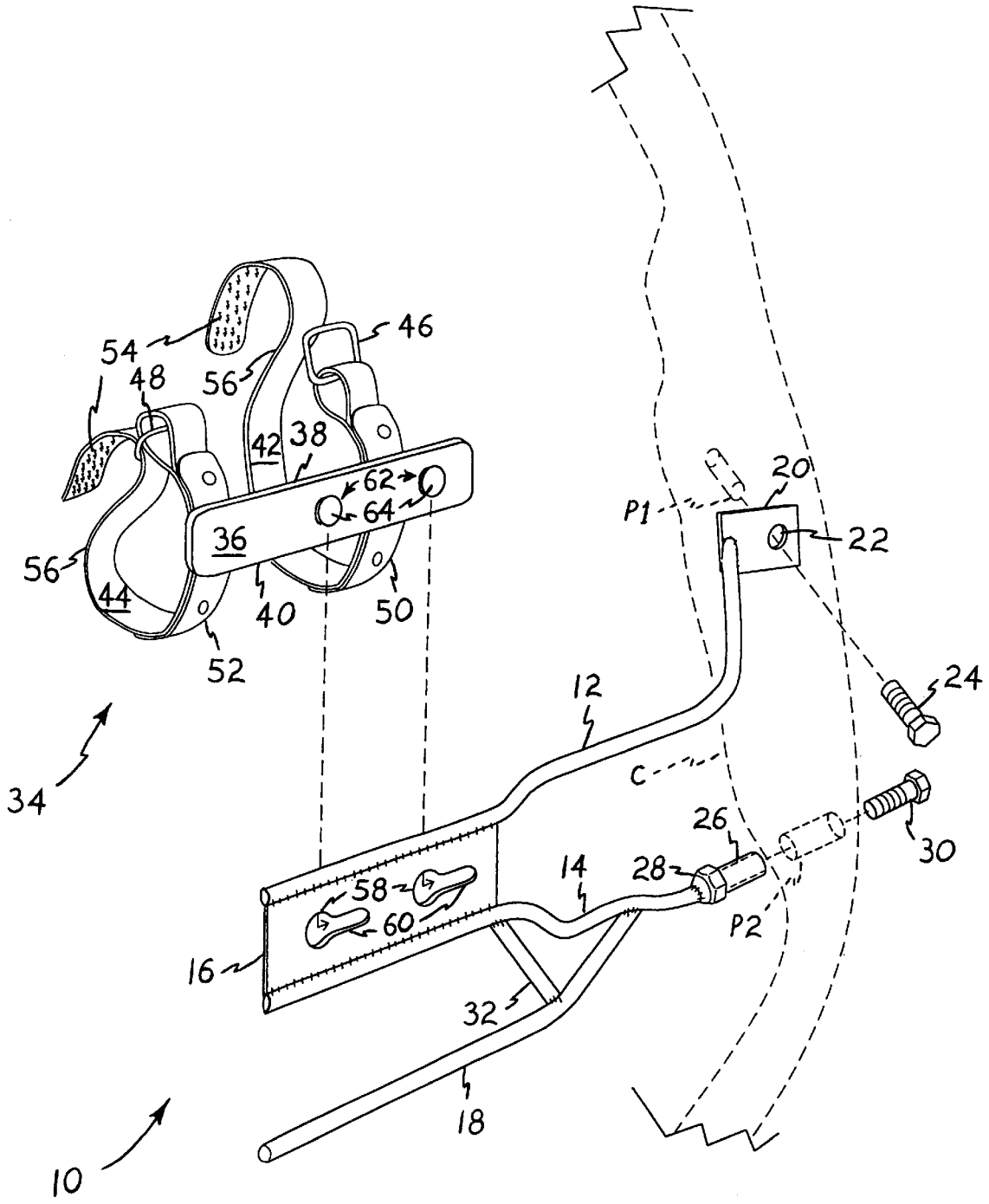
FIG. 2 is an exploded perspective view of the brace and guard of FIG. 1, illustrating further details thereof.
Figure 3:
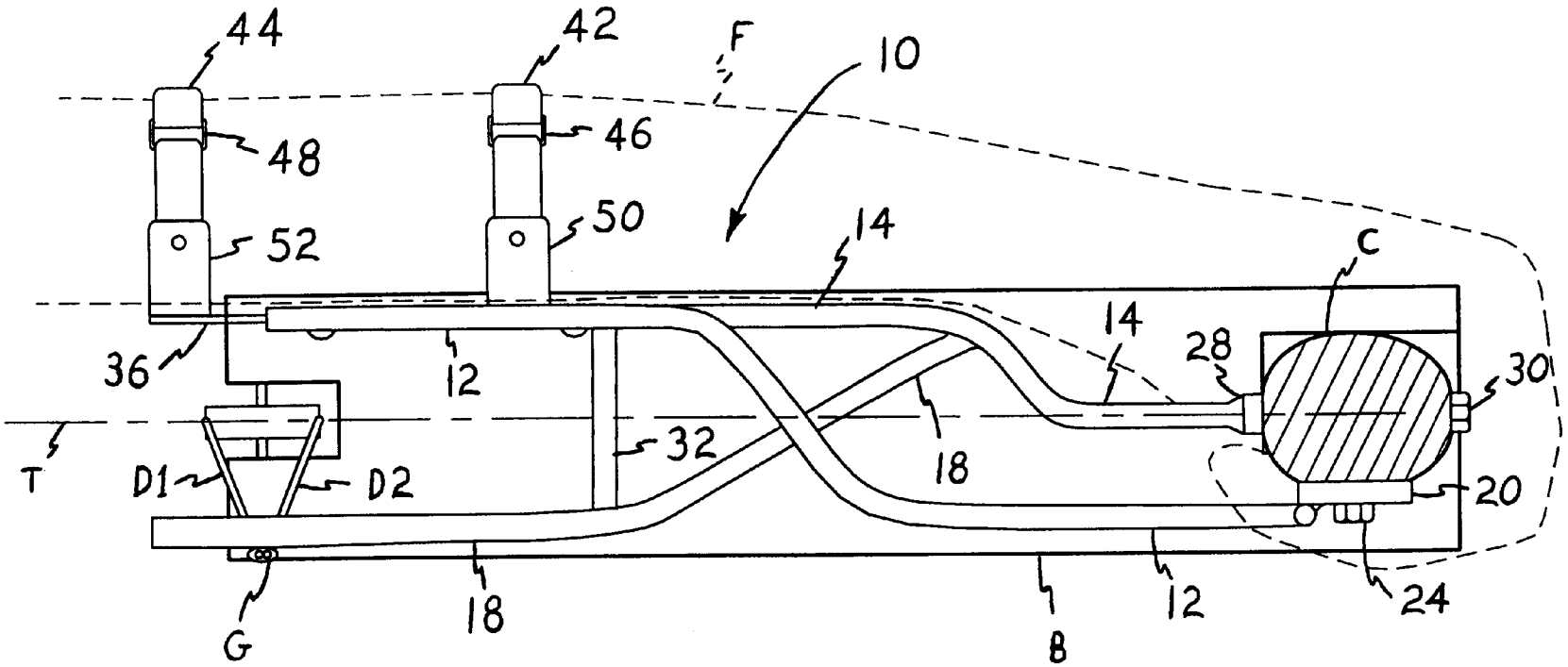
FIG. 3 is a top plan view of the brace and guard of FIG. 1 installed upon a compound bow and showing various alignments and features thereof, with the top portion of the bow removed for clarity.

FIGS. 1 through 3 illustrate a first embodiment of the present forearm brace and guard, designated by the reference numeral 10 in the drawing Figures. The brace and guard 10 is secured to a compound archery bow B in FIG. 1, with an archer holding the hand grip H of the bow B with the bow holding forearm F and drawing the bowstring S and arrow A rearwardly with the opposite arm, as is conventionally done in archery. The bow B includes a conventional overdraw arrow rest attachment point P1 formed laterally in or through the center structure C of the bow B just above the hand grip portion H, and a stabilizer attachment point P2 formed longitudinally through the bow center structure C just below the hand grip area H.

The archery bow forearm brace and guard 10 secures to the bow center structure C at the two separate points P1 and P2, respectively above and below the hand grip area H of the center structure C. This two point attachment at widely spaced points above and below the archer's hand, results in a relatively rigid relationship between the brace and guard 10 and the bow B.

The forearm brace and guard 10 essentially comprises a first or upper brace attachment arm 12 which secures removably to the overdraw attachment point P1 of the bow center structure C and extends rearwardly therefrom, and a second or lower brace attachment arm 14 which secures removably to the stabilizer attachment point P2 of the bow center C and extends rearwardly therefrom. The upper and lower arms 12 and 14 are bent or formed so they run somewhat closer together and parallel to one another as they extend rearwardly from the bow center structure C, and include a crossmember plate 16 secured (welded, etc.) therebetween. The crossmember plate 16 provides for the removable attachment of the forearm attachment means to the arms 12 and 14, and thus to the bow B, as described further below and shown in more detail in FIG. 2 of the drawings. A third arm 18 extends generally rearwardly and below the second or lower brace attachment arm 14, and serves as a guide for the conventional cable guard G which is installed along the draw cables D1 and D2 of a conventional compound bow B, at the crossover point of the two cables D1 and D2.

FIG. 2 provides a more detailed view of the structure of the present archery bow forearm brace and guard 10. The first or upper attachment arm 12 includes a plate 20 at its forward end, with the plate 20 having a hole or passage 22 therethrough. A bolt 24 or other suitable fastener passes through the hole 22 and secures in the laterally disposed overdraw attachment passage P1 of the bow center structure C. The second or lower arm 14 includes a threaded sleeve 26 extending from the forward end thereof, which is inserted through the conventional longitudinally disposed stabilizer attachment passage P2 of the center structure C of the bow. A stop 28 is provided at the rearward limit of the sleeve 26, where it joins the forward end of the arm 14, to limit the insertion depth of the sleeve 26 and define the positioning of the assembly relative to the bow center C. Another bolt 30 or other suitable fastener installs through the front side of the passage P2 and threads into the sleeve 26 to secure the lower or second arm 14 to the bow center structure C. The lateral attachment of the first or upper arm 12 to the bow center structure C by means of the plate 20, and the longitudinal attachment of the second or lower arm 14 by means of the forward sleeve 26 and bolt 30, result in a very rigid attachment for the assembly. This rigid attachment, in combination with the rigidly welded or otherwise secured crossmember plate 16 extending between the two arms 12 and 14, provides an extremely rigid bow and brace assembly. An additional reinforcement member 32 is provided between the lower arm 14 and the cable guide arm 18, for further rigidity of that structure.

The crossmember plate 16 of FIG. 2 provides for the removable but rigid and positive attachment of forearm attachment means 34 thereto. The forearm attachment means 34 comprises an elongate forearm strap base plate 36 having a first side or edge 38 corresponding to the first or upper arm 12, and an opposite second side or edge 40 corresponding to the second or lower arm 14. First and second straps, respectively 42 and 44, extend from the second side 40, with corresponding anchor loops, respectively 46 and 48, extending from the first side 38 of the plate 36. Rigid brace straps, respectively 50 and 52, may be rigidly and permanently affixed (welded, riveted, etc.) to extend across the plate 36 for greater structural strength and rigidity of the assembly 34.

Each strap 42 and 44 is configured to provide for the quick attachment of the forearm attachment assembly 34 to the bow holding forearm of an archer, and for corresponding quick release therefrom. Each strap 42 and 44 has an outer surface including two different types of hook and loop fastening material (e. g., Velcro, tm) disposed thereon, with a first type disposed upon the distal end portions 54 of the straps and a mating second type disposed upon the inboard portions 56 of the straps. (The second type is not visible in FIG. 2 due to the orientation of the strap surfaces, but will be understood to be conventional.) Thus, when the distal end portions 54 of the straps 42 and 44 are passed through their respective buckle anchor loops 46 and 48 which extend from the opposite end of their respective rigid brace straps 50 and 52, as shown with the second strap 44 in FIG. 2, they are doubled back upon themselves with the two corresponding strap portions 54 and 56 being pressed together to removably attach the two different mating hook and loop materials to one another, thus quickly and conveniently securely capturing the bow holding forearm of the archer therein, as shown in FIG. 1 of the drawings. It will be seen that the assembly 34 is just as quickly and easily removed from the archer's forearm, by pulling the mating hook and loop fastener portions of the straps 42 and 44 apart from one another.

The present forearm brace and guard 10 with its forearm attachment assembly 34 also provide for the quickly releasable attachment of the assembly 34 to the remainder of the brace and guard 10, as shown in FIG. 2. The crossmember plate 16 extending between the two arms 12 and 14 includes a pair of stud passages 58 therethrough, with each passage 58 including a narrower stud capturing slot 60 extending therefrom. The forearm strap attachment base plate 36 includes a pair of studs 62 extending therefrom, opposite the straps 42 and 44 and their brace straps 50 and 52 and located so as to align with the corresponding stud passages 58 of the crossmember plate 16 when the forearm strap plate 36 is assembled therewith. Each stud 62 has a relatively wide head 64, having a diameter just slightly smaller than the passages 58 of the crossmember plate 16 to allow the stud heads 64 to pass therethrough. However, the heads 64 are a larger diameter than the width of the stud retaining slots 60 of the plate 16.

Each stud 62 has a narrower shank (not shown in the drawings, but conventional) which has a diameter slightly smaller than the width of the slots 60 of the crossmember plate, to fit therein. This arrangement provides means for the quick attachment and release of the forearm strap assembly 34 to the crossmember plate 16 of the two bow attachment arms 12 and 14, by inserting the two stud heads 64 through the corresponding passages 58 of the crossmember plate 16, and sliding the forearm strap plate 36 to capture the stud shanks within the slots 60 of the crossmember plate 16, thereby capturing the stud heads 64 behind the plate 16.

Figure 5:
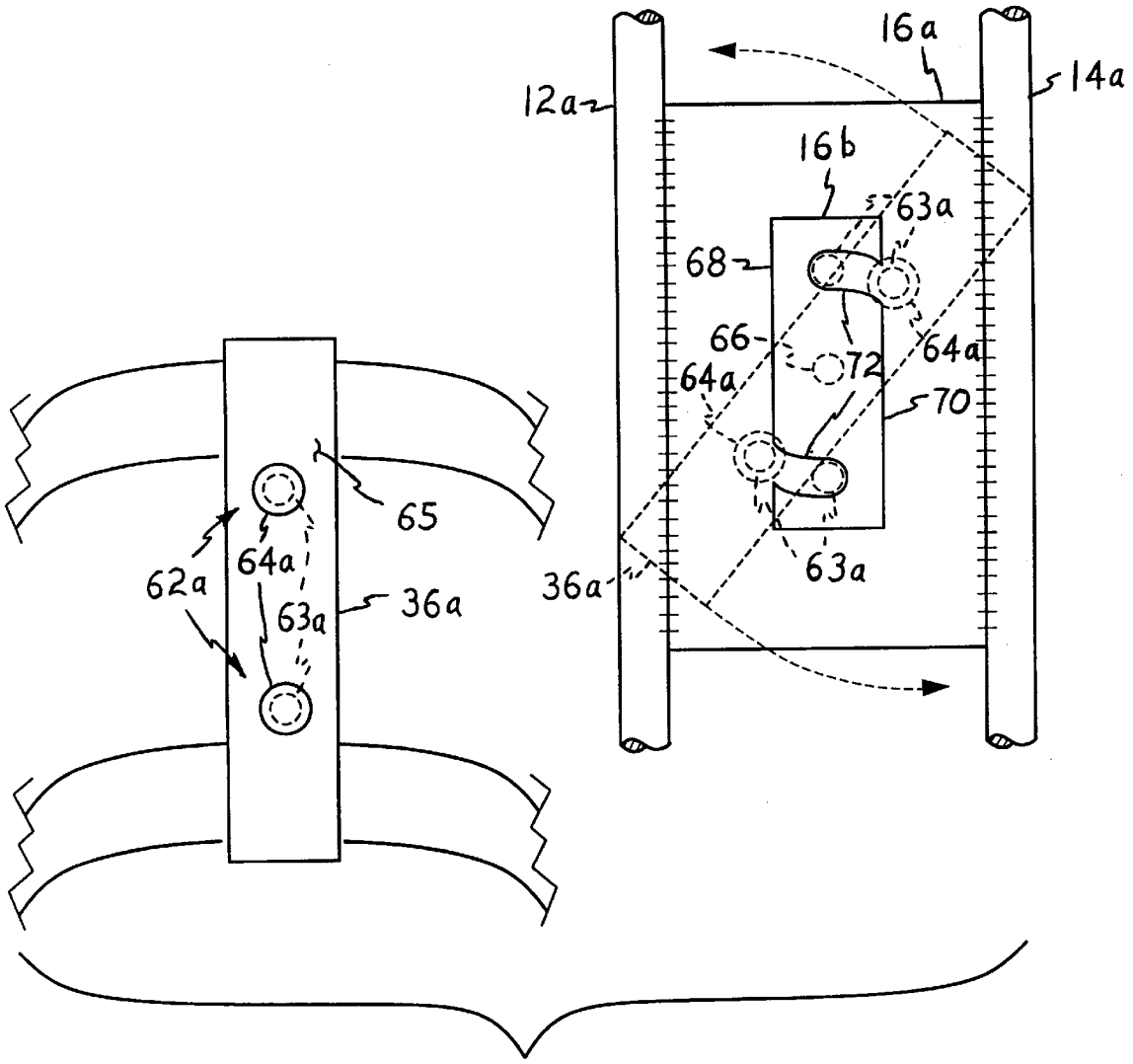
FIG. 5 is an exploded broken away elevation view of a third embodiment of the present invention, showing an alternative means of removably securing the forearm strap attachment assembly to the remainder of the device.

FIG. 5 of the drawings illustrates an alternative embodiment to provide the quick release and attachment means for the forearm strap assembly and crossmember. In FIG. 5, a crossmember 16*a* extends between the two arms 12*a* and 14*a*, with a second crossmember plate 16*b* spaced apart from and parallel to the primary crossmember 16*a* and rigidly and immovably secured thereto by a central stud 66 or the like. The secondary crossmember plate 16*b* has a first edge 68, an opposite second edge 70, and a center defined by the stud 66. The two edges 68 and 70 each have an arcuate slot 72 formed therein, with the two slots 72 being diagonally disposed across the center stud 66 and across the plate 16*b* from one another.

The forearm strap plate 36*a* includes a pair of studs 62*a*, having heads 64*a* with diameters larger than the slots 72, and shanks 63*a* extending from the attachment side or surface 65 thereof; the shanks are slightly narrower than the widths of the two slots 72. This configuration is essentially the same as the forearm strap plate 36 with its studs 62 illustrated in FIG. 2 of the drawings and discussed further above. The stud shanks 63*a* are spaced apart a distance equal to the span between the two slots 72 of the secondary plate 16*b*, Thus, when the forearm strap plate 36*a* is inverted (as shown in the broken line rendering of that plate 36*a* superimposed over the primary and secondary plates 16*a* and 16*b* in FIG. 5) and twisted to engage the studs 62*a* with the slots 72, the stud shanks 63*a* engage the slots 72 with the stud heads 64*a* being captured behind the second plate 16*b* to releasably lock the forearm strap plate 36*a* to the remaining structure.

FIG. 3 of the drawings provides a top plan view of the present bow forearm brace and guard 10 installed upon a compound bow B, generally along section line 3—3 of FIG. 1. FIG. 3 illustrates the relationship between the archer's bow holding forearm F, the bowstring path of travel T, and the present brace and guard 10 when secured to the center structure C of the bow B as shown in FIGS. 1 and 2 of the drawings. (It will be seen that the bowstring travel T and corresponding arrow launch path do not travel through the bow center structure C; this portion of the bow is conventionally laterally offset to provide straight travel for the launch of an arrow and corresponding bowstring travel.)

The upper and lower arms 12 and 14 include lateral offsets to offset their rearward portions, and thus the crossmember plate extending therebetween and the forearm attachment plate 36 removably secured thereto, laterally from the longitudinal axis of the bow B as defined by the path of travel T of the arrow and bowstring. As the bow holding forearm F of the archer is secured by the two straps 42 and 44 to the side of the forearm attachment plate 36 opposite the crossmember 16 and its attached arms 12 and 14, it will be seen that the archer's forearm F thus remains clear of the travel path T of the bowstring at all times when the present invention is assembled to the bow B and secured to the archer's forearm F as shown and described. The present invention thus does not serve merely as a protective cover for the archer's forearm to absorb the impact of the bowstring, but rather keeps the forearm and other structure clear of the bowstring to preclude contact.

The present invention provides an additional advantage, in that the rearwardly extending mass provides considerable stabilizing influence, greatly reducing bow vibration during the launch of an arrow. This function is achieved by various devices of the prior art, but none provide the additional advantage of precluding contact by the bowstring with the archer's forearm during release of the bowstring, as provided by the present invention. It will be seen that the positive attachment of the archer's bow holding forearm to the structure of the present invention by means of the forearm attachment straps 42 and 44, effectively locks the mass of the archer's forearm to the present brace and guard 10, and thus to the bow center structure C, thereby providing additional effective stabilizing mass for the bow B by means of the archer's forearm being securely and positively secured to the bow B.

Finally, the present bow brace and bowstring guard 10 provides yet another function, in that the cable guide arm 18 deflects the two draw cables D1 and D2 laterally to one side, so that they remain clear of the travel path T of the bowstring, and thus the arrow, during launch. The two draw cables are not drawn or deflected rearwardly or forwardly during the drawing and release of the bowstring, but rather draw the two limbs of the bow together as the bowstring is drawn. The cable guard G precludes chafing of these two draw cables D1 and D2 against one another, and against the cable guide arm 18, during the drawing and release of the bowstring.

Figure 4:
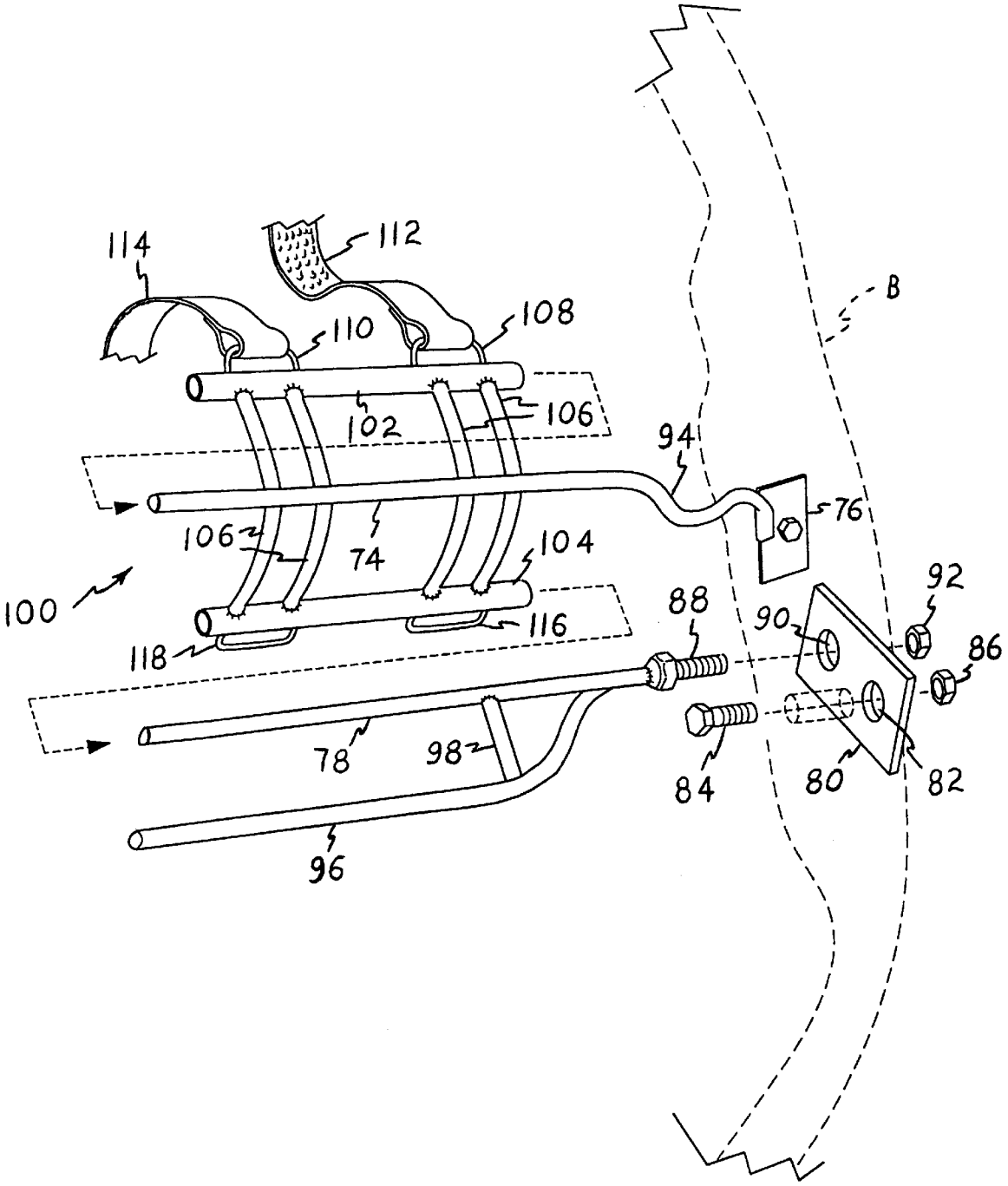
FIG. 4 is an exploded perspective view of a second embodiment of the present forearm brace and guard, showing various details.

FIG. 4 illustrates an exploded perspective view of another embodiment of the present invention, in which the two attachment arms are separate from one another and the crossmember assembly is longitudinally adjustable along the two arms. In FIG. 4, a first or upper arm 74 has an attachment plate 76 at its forward end, for securing to the overdraw attachment point in the center structure of a conventional bow B, similar to the attachment means used for the first or upper arm 14 of the first embodiment of FIGS. 1 through 3. A second or lower arm 78 attaches (directly or indirectly) to the stabilizer attachment point of the bow, generally as shown in FIG. 2 of the drawings and described further above.

However, additional mounting freedom may be provided for different bows having different widths, by first securing an offset attachment plate 80 to the front side of the bow at the stabilizer attachment point, generally as shown in FIG. 4. A bow attachment hole 82 is formed through the plate 80, with a bolt 84 and mating nut 86 used to secure the plate 80 to the bow at the conventional stabilizer attachment point. The forward end of the second arm 78 includes an externally threaded section 88, which is inserted through a hole 90 in the plate 80 and secured thereto by a nut 92. Different plates 80, and/or plates having different spacing between their bow attachment and second arm attachment holes 82 and 90, may be provided as necessary in order to adjust for different widths or lateral thicknesses of different bow center structures.

It will be noted that at least the first or upper arm 74 includes a laterally offset portion 94, which serves to offset the first arm 74 laterally from the longitudinal centerline of the bow as defined by the bowstring travel path, as shown in FIG. 3 of the drawings. The lower or second arm 78 does not require any lateral offset in this embodiment, as the offset mounting hole 90 in the attachment plate 82 provides the required lateral offset. The lower or second arm 78 also has a draw cable guide arm 96 extending therefrom which is braced by a brace 98, similar to the guide arm structure 18 and 32 of the first embodiment 10 illustrated in FIGS. 1 through 3 of the drawings.

However, the bow forearm brace and guard of FIG. 4 differs in that the two arms 74 and 78 are not directly secured to one another, as in the first embodiment. This provides for freedom of adjustment of the two arms 74 and 78 for different bow structures, and also allows the forearm guard crossmember assembly 100 to be removably and adjustably assembled to the two arms 74 and 78. The crossmember assembly 100 of FIG. 4 essentially comprises a first or upper tube 102 and opposite second or lower tube 104, which tubes 102, 104 have inner diameters closely fitting the diameters of the two arms 74, 78. The tubes 102 and 104 of the crossmember assembly 100 define a first side (the first or upper tube 102) and a second side (the second or lower tube 104) for the assembly 100, for removably installing upon the corresponding first or upper and second or lower arms 74 and 78 of the device. Locking means (set screws, etc.) may be provided through the tubes 102 and 104.

The tubes 102, 104 are connected by at least one (preferably a plurality of) crossmember brace(s) 106 extending therebetween, and rigidly and immovably connecting the two tubes 102 and 104 together (e. g., welded, etc.). At least one first or upper side strap attachment loop (preferably first or forward and second or rearward loops 108 and 110) extends from the first or upper tube 102, with a corresponding strap (or straps 112 and 114) extending therefrom. At least one second or lower side strap attachment anchor loop (preferably first or forward and second or rearward anchor loops 116 and 118) extends from the second lower tube 104.

The straps 112, 114 are configured similarly to the straps 42, 44 of the first embodiment shown in FIGS. 1 through 3, with mating hook and loop fastener material disposed over one surface thereof for passing through the opposite lower side anchor loops 116 and 118 and securing to their corresponding mating surfaces to quickly and removably secure the crossmember assembly 100 to the forearm of the archer. It will be noted that the two straps 112 and 114 of the embodiment of FIG. 4 extend from the two upper attachment loops 108 and 110, and removably secure to the two opposite lower anchor loops 116 and 118, in the opposite configuration of that shown in FIG. 2 for the first embodiment of the present invention. It will be appreciated that this reversal of attachment of the straps is not critical to the function of the present invention, and that the straps of either embodiment may be secured to either the upper or lower anchor or attachment loops of any of the crossmember embodiments, as desired.

In summary, the present archery bow forearm brace and guard provides a much needed consolidation of various devices of the prior art into a single easily used article. The various embodiments of the present secure rigidly yet removably to the conventional attachment points of a compound bow or long bow, to provide solid attachment to the bow holding forearm of the archer. The lateral offset of the two rearwardly extending arms, along with the positive attachment of the forearm guard crossmember assembly thereto, serve to preclude any possibility of contact of the bow string with the archer's forearm, or with the crossmember assembly. While the various embodiments illustrated in the drawing Figures show devices for use by right handed archers, it will be appreciated that the present invention may be easily constructed for left handed archers by reversing the configuration to essentially "mirror images" of those shown in the present drawings.

The mass of the present brace and guard, in combination with its rigid attachment to the bow and to the forearm of the archer, provide significant additional mass for additional stabilizing of the bow as an arrow is launched, greatly reducing vibration and other undesirable motion in the bow to provide a more accurate launch for the arrow. Thus, the present invention will be greatly appreciated by all archers who have had occasion to use arm guards, stabilizers, and other related devices of the prior art.

It is to be understood that the present invention is not limited to the embodiments described above, but encompasses any and all embodiments within the scope of the following claims.

I claim:

1. An archery bow forearm brace and guard for use with an archery bow having overdraw arrow rest and stabilizer attachment points and a bowstring, comprising:

an elongate first arm for removably attaching to the overdraw arrow rest attachment point of the bow;

an elongate second arm for removably attaching to the stabilizer attachment point of the bow;

said first arm and said second arm being spaced apart from one another and extending generally rearwardly from the bow;

at least one crossmember extending between said first arm and said second arm, and securing said first arm and said second arm together;

said first arm, said second arm, and said crossmember being configured to remain clear of the travel path of the bowstring when the bowstring is released; and forearm attachment means extending from said crossmember for positively and removably securing said crossmember, said first arm, and said second arm to the bow holding forearm of an archer, and holding the forearm of the archer clear of the travel path of the bowstring.

2. The archery bow forearm brace and guard according to claim 1, wherein:

said at least one crossmember is permanently and immovably affixed between said first arm and said second arm of said forearm brace and guard.

3. The archery bow forearm brace and guard according to claim 2, wherein:

said forearm attachment means of said forearm brace and guard comprises a base removably secured to said crossmember;

said base having a first side corresponding to said first arm and a second side corresponding to said second arm;

at least one strap extending from said second side of said base and an anchor extending from said first side of said base; and means for removably attaching said at least one strap to said anchor for securing the bow holding forearm of the archer therein.

4. The archery bow forearm brace and guard according to claim 3, including:

quick release means for removably attaching said at least one strap of said forearm brace and guard to said anchor.

5. The archery bow forearm brace and guard according to claim 3, including:

quick release means for removably attaching said base to said crossmember of said forearm brace and guard.

6. The archery bow forearm brace and guard according to claim 5, wherein said quick release means for removably attaching said base to said crossmember of said forearm brace and guard comprises:

said crossmember having a first and a second stud passage therethrough, with each said stud passage including a narrower stud capturing slot extending therefrom;

a forearm strap plate;

a first stud and a second stud extending from said forearm strap plate;

each said stud positioned on said forearm strap plate so as to respectively removably engage said first and said second stud passage of said crossmember plate; and each said stud having a head extending therefrom, for capturing behind said crossmember plate when each said stud engages a corresponding said slot of said crossmember plate by sliding said forearm strap plate relative to said crossmember plate.

7. The archery bow forearm brace and guard according to claim 5, wherein said quick release means for removably attaching said base to said crossmember of said forearm brace and guard comprises:

a crossmember plate extending from and generally parallel to said crossmember;

said crossmember plate having a first edge, a second edge opposite said first edge, and a center;

a first slot formed in said first edge and a second slot formed in said second edge of said crossmember plate, with said first slot and said second slot disposed generally diagonally from one another across said crossmember plate;

a forearm strap plate;

a first stud and a second stud extending from said forearm strap plate;

each said stud positioned on said forearm strap plate so as to respectively removably engage said first slot and said second slot of said crossmember plate; and each said stud having a head extending therefrom, for capturing behind said crossmember plate when each said stud engages a corresponding said slot of said crossmember plate by twisting said forearm strap plate relative to said crossmember plate.

8. The archery bow forearm brace and guard according to claim 1, wherein:

said at least one crossmember is removably and adjustably secured to said first arm and to said second arm of said forearm brace and guard.

9. The archery bow forearm brace and guard according to claim 8, wherein:

said at least one crossmember has a first side for securing to said first arm and a second side for securing to said second arm of said forearm brace and guard;

said forearm attachment means comprises at least one strap extending from said first side of said at least one crossmember; and an anchor extending from said second side of said at least one crossmember for removably securing said at least one strap thereto.

10. The archery bow forearm brace and guard according to claim 9, including:

quick release means for removably attaching said at least one strap of said forearm attachment means to said second side of said at least one crossmember.

11. An archery bow having an overdraw arrow rest attachment point and a separate stabilizer attachment point and a bowstring defining a bowstring travel path, and an archery bow forearm brace and guard therefor, comprising in combination:

an elongate first arm for removably attaching to said overdraw arrow rest attachment point of said bow;

an elongate second arm for removably attaching to said stabilizer attachment point of said bow;

said first arm and said second arm being spaced apart from one another and extending generally rearwardly from said bow;

at least one crossmember extending between said first arm and said second arm, and securing said first arm and said second arm together;

said first arm, said second arm, and said crossmember being configured to remain clear of said travel path of said bowstring when said bowstring is released; and forearm attachment means extending from said crossmember for positively and removably securing said crossmember, said first arm, and said second arm to the bow holding forearm of an archer, and holding the forearm of the archer clear of said travel path of said bowstring.

12. The archery bow and forearm brace and guard combination according to claim 11, wherein:

said at least one crossmember is permanently and immovably affixed between said first arm and said second arm of said forearm brace and guard.

13. The archery bow and forearm brace and guard combination according to claim 12, wherein:

said forearm attachment means of said forearm brace and guard comprises a base removably secured to said crossmember;

said base having a first side corresponding to said first arm and a second side corresponding to said second arm;

at least one strap extending from said second side of said base and an anchor extending from said first side of said base; and means for removably attaching said at least one strap to said anchor for securing the bow holding forearm of the archer therein.

14. The archery bow and forearm brace and guard combination according to claim 13, including:

quick release means for removably attaching said at least one strap of said forearm brace and guard to said anchor.

15. The archery bow and forearm brace and guard combination according to claim 13, including:

quick release means for removably attaching said base to said crossmember of said forearm brace and guard.

16. The archery bow and forearm brace and guard combination according to claim 15, wherein said quick release means for removably attaching said base to said crossmember of said forearm brace and guard comprises:

said crossmember having a first and a second stud passage therethrough, with each said stud passage including a narrower stud capturing slot extending therefrom;

a forearm strap plate;

a first stud and a second stud extending from said forearm strap plate;

each said stud positioned on said forearm strap plate so as to respectively removably engage said first and said second stud passage of said crossmember plate; and each said stud having a head extending therefrom, for capturing behind said crossmember plate when each said stud engages a corresponding said slot of said crossmember plate by sliding said forearm strap plate relative to said crossmember plate.

17. The archery bow and forearm brace and guard combination according to claim 15, wherein said quick release means for removably attaching said base to said crossmember of said forearm brace and guard comprises:

a crossmember plate extending from and generally parallel to said crossmember;

said crossmember plate having a first edge, a second edge opposite said first edge, and a center;

a first slot formed in said first edge and a second slot formed in said second edge of said crossmember plate, with said first slot and said second slot disposed generally diagonally from one another across said crossmember plate;

a forearm strap plate;

a first stud and a second stud extending from said forearm strap plate;

each said stud positioned on said forearm strap plate so as to respectively removably engage said first slot and said second slot of said crossmember plate; and each said stud having a head extending therefrom, for capturing behind said crossmember plate when each said stud engages a corresponding said slot of said crossmember plate by twisting said forearm strap plate relative to said crossmember plate.

18. The archery bow and forearm brace and guard combination according to claim 11, wherein:

said at least one crossmember is removably and adjustably secured to said first arm and to said second arm of said forearm brace and guard.

19. The archery bow and forearm brace and guard combination according to claim 18, wherein:

said at least one crossmember has a first side for securing to said first arm and a second side for securing to said second arm of said forearm brace and guard;

said forearm attachment means comprises at least one strap extending from said first side of said at least one crossmember; and an anchor extending from said second side of said at least one crossmember for removably securing said at least one strap thereto.

20. The archery bow and forearm brace and guard combination according to claim 19, including:

quick release means for removably attaching said at least one strap of said forearm attachment means to said second side of said at least one crossmember.

* * * * *